US008267838B2

(12) United States Patent
Rasmussen

(10) Patent No.: US 8,267,838 B2
(45) **Date of Patent: *Sep. 18, 2012**

(54) REHABILITATION SUPPORT APPARATUS

(75) Inventor: Glenn Rasmussen, Sioux Falls, SD (US)

(73) Assignee: Solo-Step, Inc., Sioux Falls, SD (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/206,331

(22) Filed: Aug. 9, 2011

(65) Prior Publication Data

US 2011/0294626 A1 Dec. 1, 2011

Related U.S. Application Data

(63) Continuation of application No. 11/764,463, filed on Jun. 18, 2007, now Pat. No. 7,993,248, which is a continuation of application No. 11/230,997, filed on Sep. 20, 2005, now abandoned, which is a continuation of application No. 10/638,202, filed on Aug. 11, 2003, now abandoned.

(51) Int. Cl.
*A63B 22/00* (2006.01)

(52) U.S. Cl. ..... 482/69

(58) Field of Classification Search ..... 482/66–69
See application file for complete search history.

(56) References Cited

U.S. PATENT DOCUMENTS

| | | | |
|---|---|---|---|
| 3,780,663 | A | 12/1973 | Pettit |
| 4,125,908 | A | 11/1978 | Vail et al. |
| 4,164,350 | A | 8/1979 | Zeijdel et al. |
| 4,252,063 | A | 2/1981 | Brooks, Jr. |
| 4,256,098 | A | 3/1981 | Swan et al. |
| 4,303,041 | A | 12/1981 | Thompson et al. |
| 4,410,175 | A | 10/1983 | Shamp |
| 4,911,426 | A | 3/1990 | Scales |
| 5,458,550 | A | 10/1995 | Braim et al. |
| 5,626,540 | A | 5/1997 | Hall |
| 5,669,858 | A | 9/1997 | Blair et al. |
| 5,927,431 | A | 7/1999 | Klein, Jr. |
| 5,993,361 | A | 11/1999 | Paoli et al. |
| 6,622,634 | B2 | 9/2003 | Cylvick |
| 6,832,417 | B1 | 12/2004 | Choate |
| 2003/0207737 | A1 | 11/2003 | Sherman et al. |
| 2004/0204300 | A1 | 10/2004 | Hetrick |

*Primary Examiner* — Fenn Mathew

(74) *Attorney, Agent, or Firm* — McKee, Voorhees & Sease, P.L.C.

(57) ABSTRACT

The present invention provides an overhead support apparatus for assisting a user while performing rehabilitation physical activities and includes a track assembly supported by the ceiling and a suspension device that depends from the track assembly and is attached to the user so that the apparatus acts to prevent the user from falling down during physical activities. The suspension assembly includes a trolley adapted to traverse the track assembly, a locking snap assembly attached to the trolley and associated with a swivel, and an adjustable lanyard that is connected to the swivel at one end and to a body harness at its opposite end, which body harness has straps for encircling the torso and legs of a user.

17 Claims, 7 Drawing Sheets

REHABILITATION SUPPORT APPARATUS

CROSS-REFERENCE TO RELATED APPLICATIONS

This application is a continuation of U.S. application Ser. No. 11/764,463 filed Jun. 18, 2007, which is a continuation of U.S. application Ser. No. 11/230,997 filed Sep. 20, 2005, which is a continuation of U.S. application Ser. No. 10/638,202 filed Aug. 11, 2003, all of which are hereby incorporated by reference in their entirety.

BACKGROUND OF THE INVENTION

1. Field of the Invention

The present invention relates in general to a rehabilitation support system particularly adapted for utilization by those having debilitating ambulatory conditions due to their age or injuries they have suffered and more specifically relates to a rehabilitation support system designed for safety, comfort and simplicity of use in a wide variety of applications.

2. Description of the Prior Art

Over the years there have been numerous types of devices that have been designed to serve as solutions to the serious problem health care facilities face in having insufficient personnel for properly assisting patients with debilitating ambulatory conditions as a result of their age, disease or injury. The need for such devices is caused by the fact that it may require two to three therapists to safely treat a patient during rehabilitation activities. Typically, health care facilities do not have sufficient manpower available for properly assisting a large number of patients in performing the optimum amount of rehabilitation activities they require. This is particularly true for those patients that require dynamic exercise, gait training or balance exercising as part of their treatment while standing in an erect position.

Some of the various types of known prior art rehabilitation support systems are described in U.S. Pat. Nos. 3,780,663; 4,725,908; 4,164,350 and 4,911,426. The systems disclosed in such prior art patents generally involve patient support systems that include a support harness of some kind for the patient that is suspended from an overhead rail on which a movable mechanism is located so that a patient is supported in an erect position as rehabilitation activities are performed.

The present invention is an improvement over those prior art devices described above in that it allows freedom of movement for the patient in all directions or planes, meaning side-to-side, forward and back and even up and down with transfers or on a step, and can be utilized in combination with a treadmill, stationary bike, balance machine, etc.

BRIEF SUMMARY OF THE INVENTION

The present invention provides an overhead support apparatus for assisting a user while performing physical activities and includes a track assembly supported by the ceiling, and a safe and secure suspension assembly that is depended from the track assembly and is attached to the user so that the apparatus acts to prevent the user from falling down during physical activities.

The suspension assembly includes a trolley adapted to traverse the track assembly, a locking snap assembly attached to the trolley and associated with a swivel means and an adjustable lanyard that is connected to the swivel means at one end and to a body harness at its opposite end, which harness has straps for encircling the torso and legs of a user. The snap assembly has an opening that is normally closed by a keeper that is spring loaded to be maintained in a closed condition. A locking lever is associated with said keeper to normally prevent movement of the keeper to an open condition.

The foregoing and other advantages of the present invention will appear from the following description. In the description, reference is made to the accompanying drawings, which form a part hereof, and in which there is shown by illustration and not of limitation a specific form in which the invention may be embodied. Such embodiment does not represent the full scope of the invention, but rather the invention may be employed in a variety of other embodiments and reference is made to the claims herein for interpreting the breadth of the invention.

DETAILED DESCRIPTION OF THE PREFERRED EMBODIMENT

Figure 1:
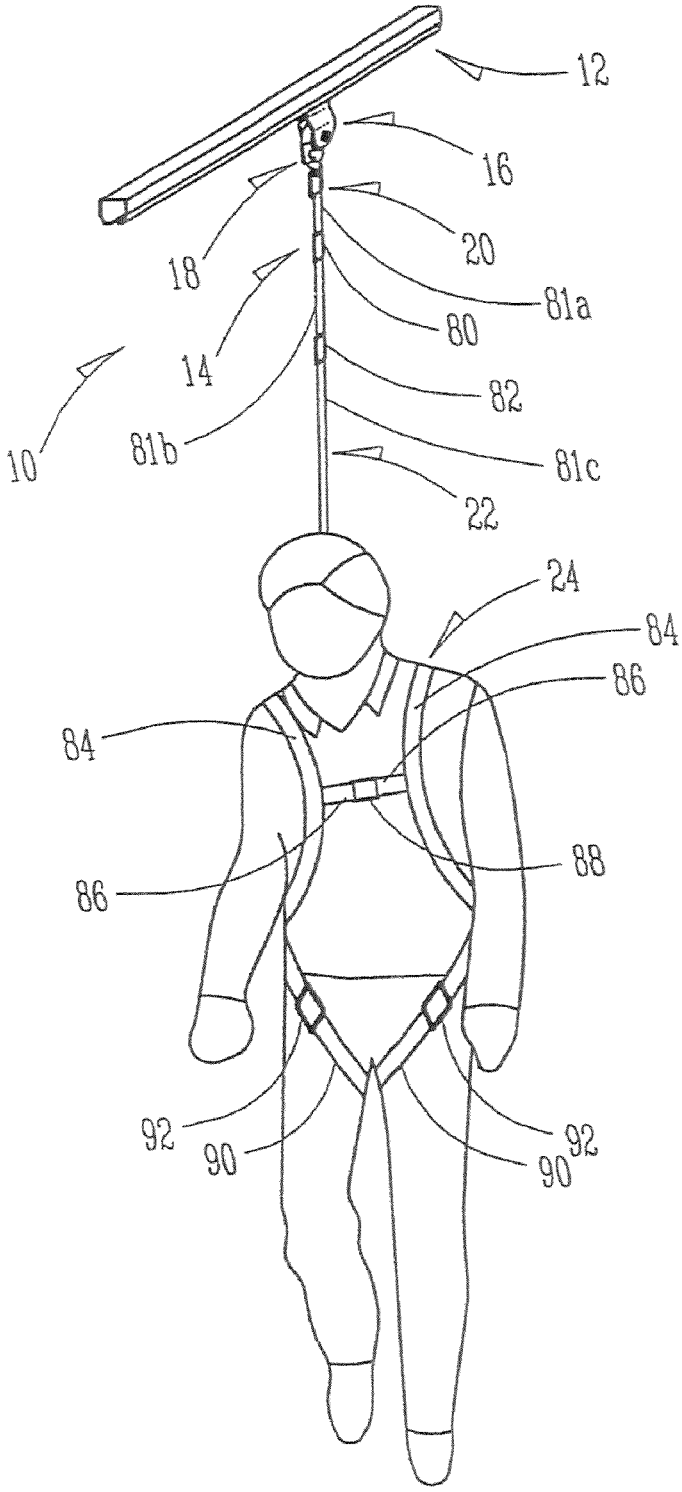
FIG. 1 is a simplified pictorial side view showing a preferred embodiment of the present invention in association with a user thereof.

Referring now to the drawings and with reference first to FIG. 1, a preferred embodiment of the rehabilitation support apparatus of the present invention is shown at 10 and it is specifically adapted for providing assistance to a user while performing rehabilitation physical activities such as dynamic exercise, gait training or balance exercising as part of their treatment while standing in an erect position.

The support apparatus 10 includes a track assembly 12 that is preferably hung by means well-known in the art from a ceiling (not shown) and a safe and secure suspension assembly 14 that is depended from the track assembly 12 and is attached to the user so that the apparatus 10 acts to prevent the user from falling down during physical activities. The suspension assembly 14 is formed of a trolley assembly 16, a locking snap assembly 18, a swivel 20, an adjustable lanyard 22 and a body harness 24 that is preferably secured around the torso and legs of a user.

Figure 2:
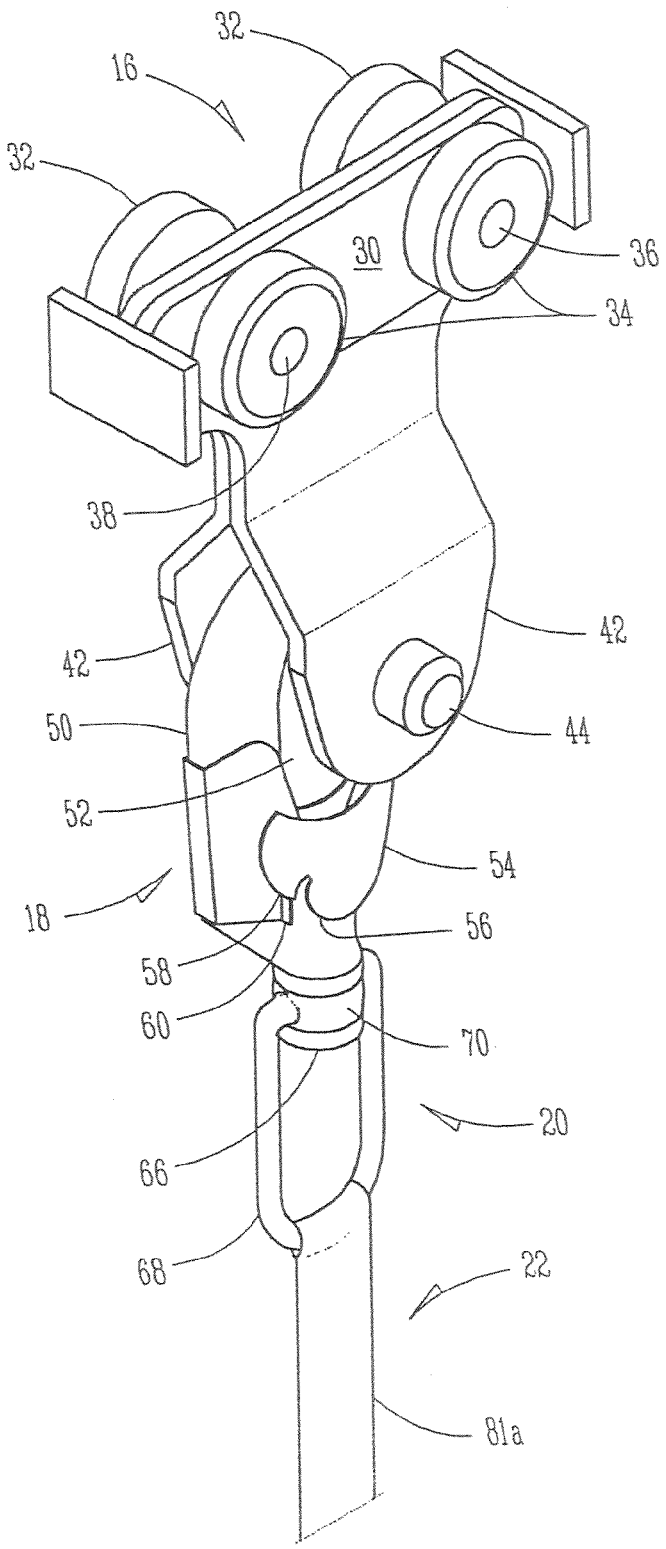
FIG. 2 is a perspective view of a trolley assembly, locking snap assembly, a swivel and the top of a lanyard that forms a portion of the preferred embodiment of the present invention.
Figure 3:
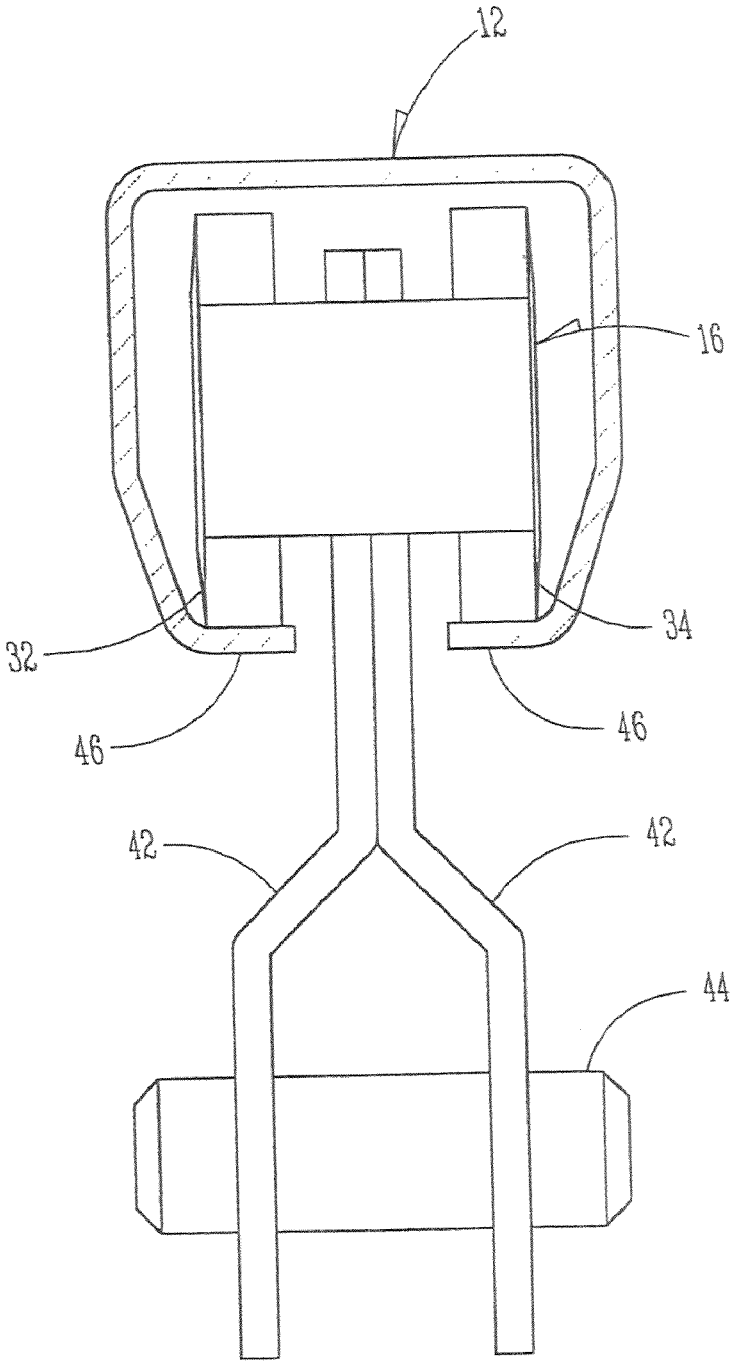
FIG. 3 is a partial cross-sectional view showing the trolley assembly suspended from a track assembly.

Referring now to FIG. 2, the trolley assembly 16 has an upper body portion 30 that serves as a mounting mean for two pairs of wheels 32 and 34 that are mounted on wheel axles 36 and 38 positioned through the trolley assembly body portion 30 in such fashion so as to place the wheels 32 and 34 in tandem. The lower section of the body portion 30 includes a pair of spaced apart trunnions 42 in which a support pin 44 is secured. As best shown in FIG. 3, the trolley assembly 16 is designed to fit within the interior of the track assembly 12, with the wheels 32 and 34 riding on spaced apart bottom edges 46 of the assembly 12.

Figure 4:
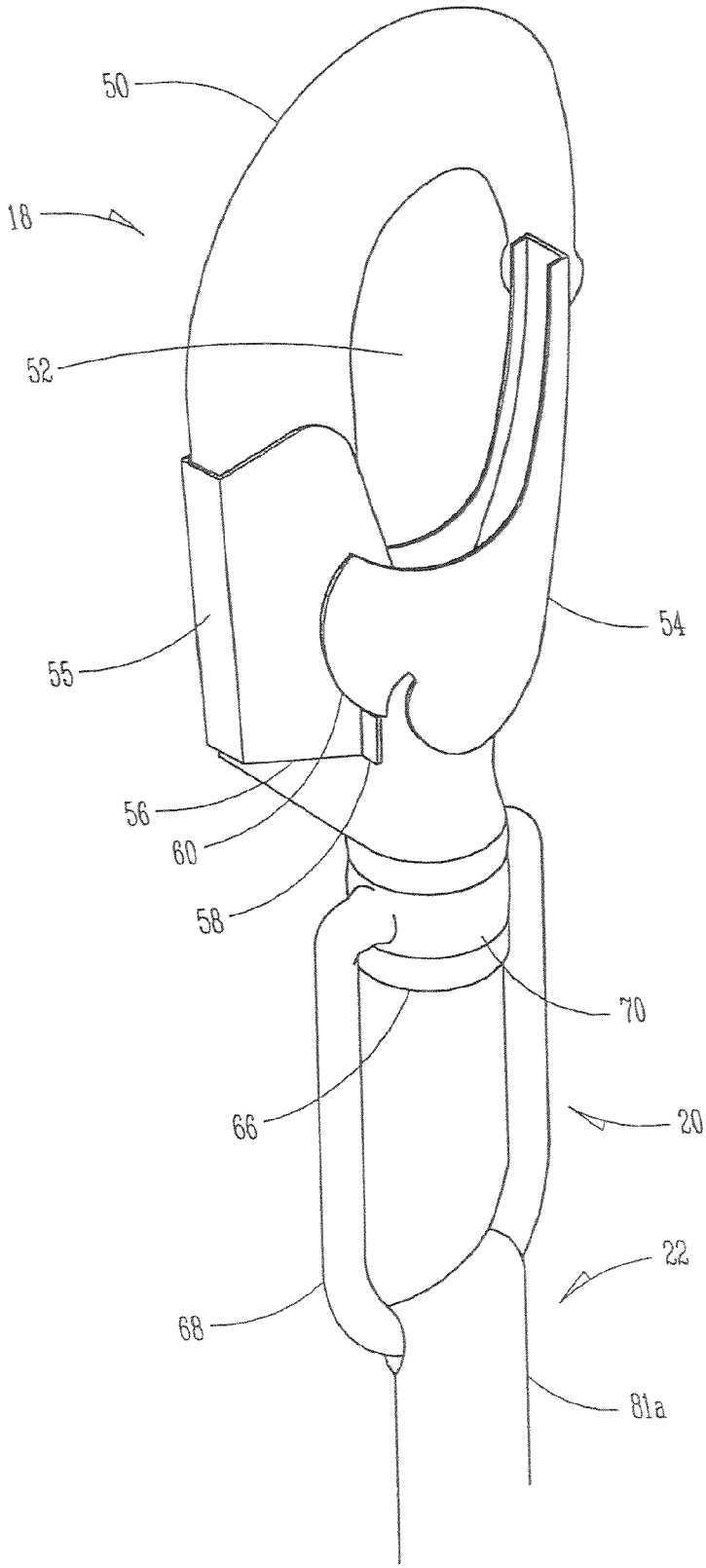
FIG. 4 is an enlarged perspective view of the locking support assembly shown in FIG. 2.
Figure 5:
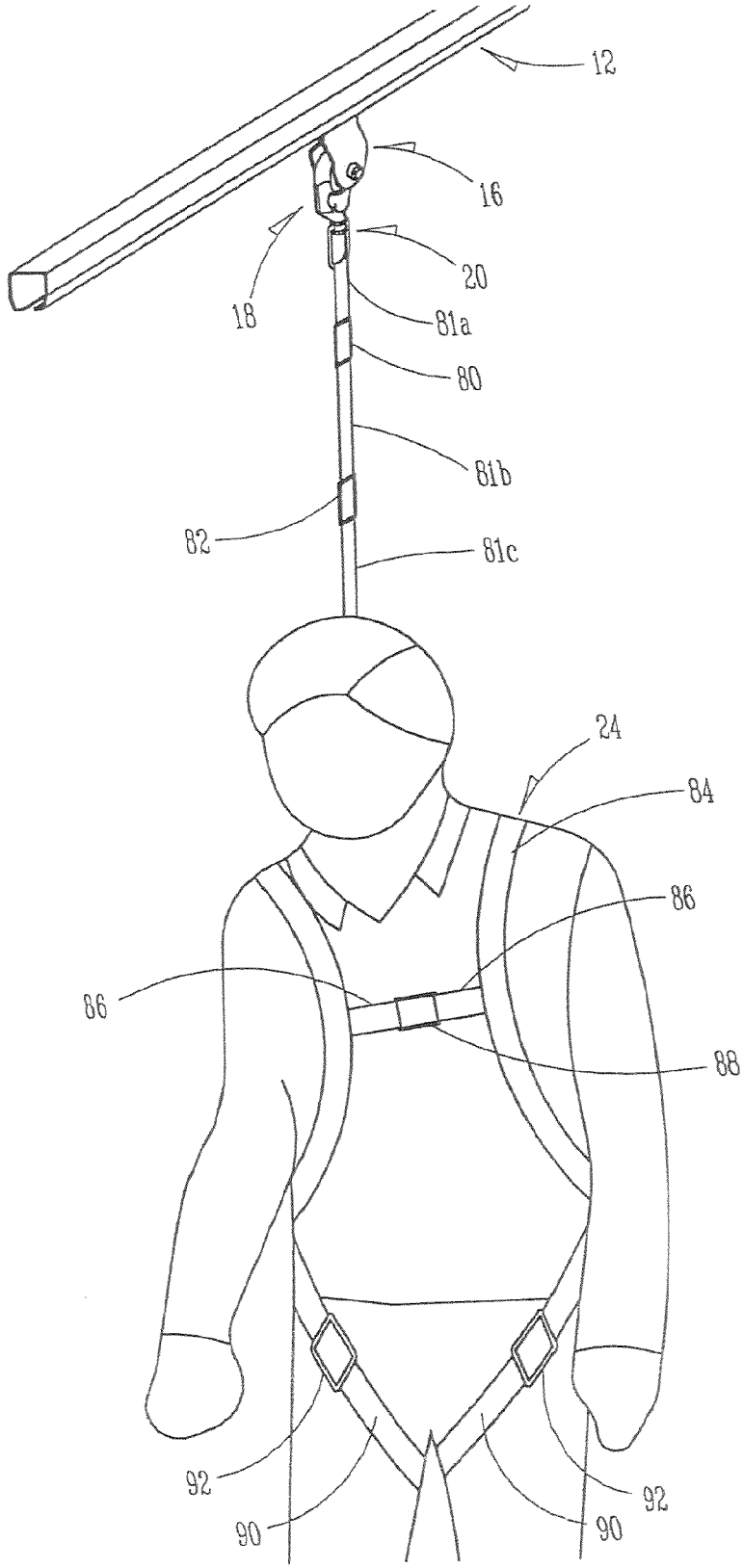
FIG. 5 is a pictorial view showing a user wearing a body harness that forms a portion of the preferred embodiment of the present invention and is connected to a lanyard.

The locking snap assembly 18, as best shown in FIG. 4, has a hook shaped main portion 50 to define an opening 52. Pivotally mounted on the main portion 50 is a keeper lever 54 that is spring biased to normally close the opening 52. A locking lever 55 is also pivotally mounted to the main portion 50 and has a bottom end 56 with an abutment 58. The lever 55 is spring biased to normally place the abutment 58 into a position directly beneath a shoulder 60 on the keeper lever 54 to prevent pivotal motion thereof into an open condition. Thus, the snap assembly 18, when secured upon the trolley assembly pin 44, is maintained in position by the keeper lever 54 and locking lever 55 to prevent the suspension assembly 14 from being inadvertently removed or to accidentally come loose from the trolley assembly 16. The bottom of the snap assembly 18 terminates in a pintle 66 that serves as a mount for an eye ring 68 to form a swivel 70.

Figure 6:
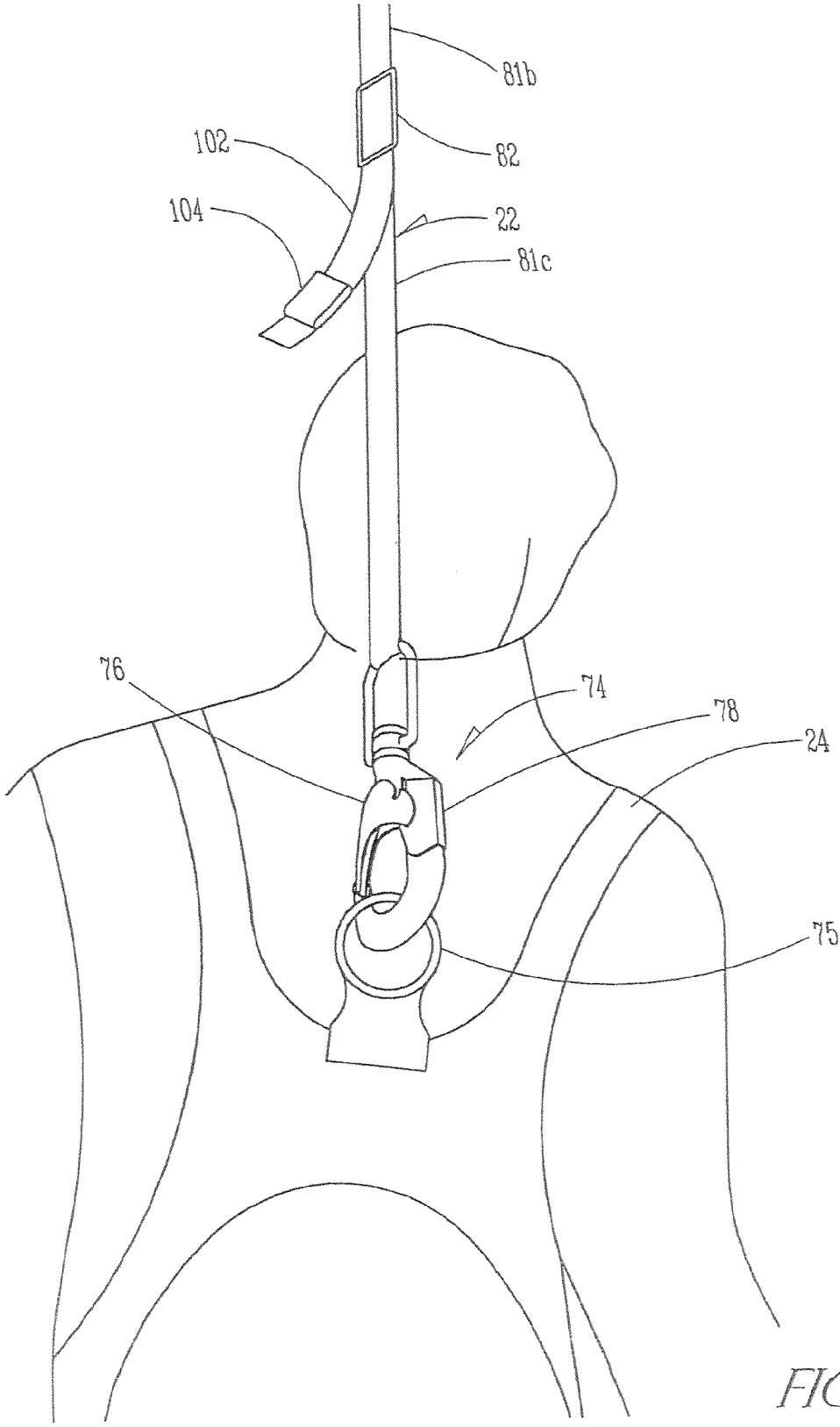
FIG. 6 is a pictorial back view of the user with the body harness shown in FIG. 5 attached to the bottom of the lanyard.

Attached to the eye ring 68 is the upper end of the adjustable lanyard 22 and the bottom end of the lanyard 22 is attached to a second snap assembly 74, as shown in FIG. 6. The assembly 74 is attached to a sturdy harness ring 75 that is fixed to the shoulder portion of the harness 24 by a strap. Similar to the snap assembly 18, the snap assembly 74 has a keeper lever 76 that is normally locked in a closed condition by a spring loaded locking lever 78.

As indicated in FIG. 1, the lanyard 22 is formed from top middle and bottom strip portions 81*a*, 81*b* and 81*c* respectively that are connected together preferably by an upper cam buckle 80 and a main cam buckle 82 for adjusting the length of the lanyard 22. The upper cam buckle 80 is used to adjust the height of the main cam buckle 82 so that it can easily be reached by a therapist for adjustment. The main cam buckle 82 is used to lower or raise the snap assembly 74 for connecting and disconnecting a user.

Figure 7:
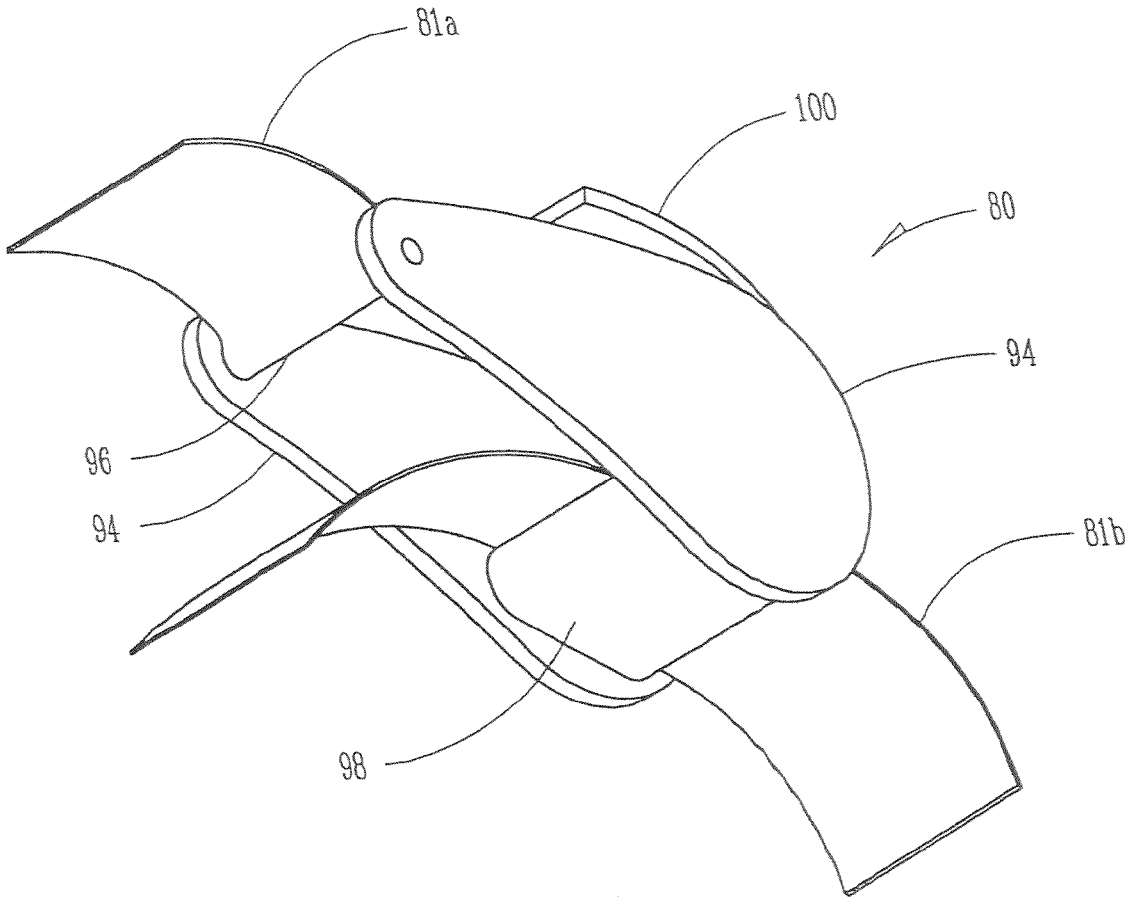
FIG. 7 is a perspective view of a portion of the lanyard and a cam buckle associated with the lanyard.

As shown in FIG. 7, the cam buckle 80 includes a pair of spaced apart sidewalls 94, an upper fixed post 96 that is attached to the lower end of the upper strap portion 81*a*. The bottom of the buckle 80 has a second fixed post 98 adjacent a spring biased brake lever 100. The upper portion of the middle strap portion 81*b* is threaded between the post 98 and a brake lever 100 so that normally the brake 100 holds the strap portion 81*b* in a fixed position. The cam buckle 82 operates in a similar fashion. However, the bottom strap portion 81*c* has a free end 102 with an enlarged portion 104, such as another cam buckle (see FIG. 6) that serves as a safety brake to prevent dropping of the user through careless operation of the apparatus 10.

The harness 24 includes a shoulder strap portion 84 that is positioned about the shoulders of the user and terminates in a pair of chest straps 86 that are connectable together by a seatbelt type fastener 88 to secure the shoulder portion to the torso of the user. The bottom portion of the harness 24 includes straps 90 with release buckles 92 that wrap around a user's legs. Consequently, the harness 24 is designed to support a user's body during a fall in a sufficiently high number of body areas so that no one area will be subjected to such high pressure so as to be likely to cause injury to the user.

Thus, the present invention provides a novel, efficient and simplistic means for providing assistance to a user while performing rehabilitation physical activity. Although the support apparatus 10 of the present invention has been described with respect to a preferred embodiment, it should be understood that such embodiment may be altered without avoiding the true spirit and scope of the present invention. It is also important to note that various modifications may be made to the disclosed embodiment.

What is claimed is:

1. A rehabilitation support apparatus comprising:

a track assembly having a generally C-shaped channel with bottom edges spaced apart by side edges connected to a top edge, the top edge of the track assembly adapted for attachment to a ceiling;

a trolley assembly having a trunnion carried by two pairs of wheels supported by the bottom edges of the C-shaped channel for traversing the track assembly;

an eyelet in a lower portion of the trunnion;

a body harness having a plurality of straps buckled together and adapted to encircle the torso, shoulder and legs of the user to safely support the user's weight;

a harness ring secured by a tether strap to the body harness on the back side of the user between shoulder straps to position the adjustable lanyard out of the way of the user to prevent interference with any rehabilatory physical activity;

a single inelastic, adjustable lanyard having a first end attached directly to the eyelet in the trunnion and a second opposite end attached directly to the harness ring; and the body harness kept at a fixed elevation from the trolley assembly by the lanyard to keep a user upright during a rehabilatory physical activity or a fall.

2. The apparatus of claim 1 wherein the trunnion comprises a body with an upper portion within the channel carried by the pair of wheels supported by the lower edges of the C-shaped channel and a lower portion connected to the upper portion of the body and extending outside the channel and terminating in the eyelet connector.

3. The apparatus of claim 1 wherein the body harness comprises a type having a plurality of straps for encircling the torso and shoulders of the user.

4. The apparatus of claim 1 wherein the harness ring comprises a harness support operatively connected to the one of the straps.

5. The apparatus of claim 4 wherein the adjustable lanyard comprises an adjustable support wherein the first end is operatively attached to the eyelet by an upper clip and the second end is operatively attached to the harness support by a lower clip.

6. The apparatus of claim 4 wherein the tether strap comprises a cord having a first end operatively attached to the body harness and a second opposite end operatively attached to the harness support.

7. The apparatus of claim 5 wherein the adjustable support further comprises at least one cam lock having a locked position and an open position to increase or decrease the separation distance between the first and second ends of the adjustable support to adjust the elevation of the body harness relative to the track assembly.

8. A rehabilitation support apparatus having the benefit of being fully adjustable to support and maintain a user in an upright standing position while undergoing rehabilatory physical activities to rehabilitate from debilitating ambulatory conditions due to age, disease or injury, the rehabilitation support apparatus comprising:

a track assembly having a generally C-shaped channel with lower edges connected to and spaced apart by side edges connected to a top edge, the track assembly adapted for mounting horizontally to a ceiling;

a trolley assembly adapted to traverse the track assembly, the trolley assembly having a body with an upper portion within the channel, the upper portion carried by a pair of wheels supported by the lower edges of the C-shaped channel, a lower portion connected to the upper portion of the body and extending outside the channel and terminating in a connector;

a body harness having a plurality of straps attached together to encircle at least the torso and shoulders of a user to safely support the user's weight;

a harness support member operatively connected to the body harness;

a cord having a first end operatively connected to the body harness and a second opposite end operatively connected to the harness support member;

an inelastic, adjustable lanyard having a first end attached directly to the connector on the lower portion of the trolley assembly by an upper clip and a second end attached directly to the harness support member by a lower clip to keep the body harness generally at the same elevation during rehabilatory physical activities or a fall;

the inelastic, adjustable lanyard having at least one cam lock having a locked position and an open position to increase or decrease the separation distance between the body harness and the trolley assembly to adjust the elevation of the body harness to keep the user generally upright during rehabilatory physical activity or a fall.

9. The apparatus of claim 8 wherein the lower edges of the channel have a space between them which the connector extends through to the upper portion.

10. The apparatus of claim 8 wherein the harness support member is operatively connected to a shoulder portion of the body harness.

11. The apparatus of claim 8 wherein the harness support member has an upper side operatively connected to the lanyard and an opposite lower side operatively connected to the cord.

12. The apparatus of claim 8 wherein the cord provides a length of separation between the harness support member and the body harness.

13. The apparatus of claim 8 wherein the lanyard has a free end drawn toward or away from the cam lock to adjust the separation distance between the body harness and the trolley assembly.

14. The apparatus of claim 8 wherein at least the lower clip includes a swivel to allow rotation of the body harness relative to the lanyard.

15. A rehabilitation support apparatus comprising:

a track assembly having a length of a generally C-shaped channel with lower edges connected to and spaced apart by sides connected to a top side adapted for attachment to a ceiling;

a trolley assembly adapted to traverse the track assembly, the trolley assembly comprising:

a. an upper portion within the channel;

b. a wheel operatively attached to opposing sides of the upper portion and supported by the lower edges of the channel;

c. a connector having a body extending through the space between the lower edges and carried by the upper portion;

a body harness having a plurality of straps attached together to encircle the torso and shoulders of a user to safely support the user's weight;

a cord having a first end operatively connected to a shoulder portion of the body harness and a second opposite end operatively connected to one side of a harness support member;

a strap having an upper portion operatively connected to the connector of the trolley assembly and a lower portion operatively connected to another side of the harness support member; and the strap having at least one cam lock with a locked position and unlocked position to increase or decrease the separation distance between the body harness and the trolley assembly to adjust the elevation of the body harness to keep the user generally upright.

16. The apparatus of claim 15 wherein the upper portion of the strap includes an upper clip attached directly to the connector of the trolley assembly.

17. The apparatus of claim 15 wherein the lower portion of the strap includes a lower clip attached directly to the harness support member.

* * * * *